US009506700B2

(12) United States Patent
Lee et al.

(10) Patent No.: US 9,506,700 B2
(45) Date of Patent: Nov. 29, 2016

(54) AIR-CONDITIONING APPARATUS

(75) Inventors: Sangmu Lee, Tokyo (JP); Mitsuhiro Ishikawa, Tokyo (JP); Akira Ishibashi, Tokyo (JP); Takuya Matsuda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 367 days.

(21) Appl. No.: 14/361,509

(22) PCT Filed: Jun. 13, 2012

(86) PCT No.: PCT/JP2012/003854
§ 371 (c)(1),
(2), (4) Date: May 29, 2014

(87) PCT Pub. No.: WO2013/094084
PCT Pub. Date: Jun. 27, 2013

(65) Prior Publication Data

US 2014/0318756 A1 Oct. 30, 2014

(30) Foreign Application Priority Data

Dec. 19, 2011 (JP) ..... 2011-276718

(51) Int. Cl.
*F28D 1/047* (2006.01)
*F28F 1/00* (2006.01)
(Continued)

(52) U.S. Cl.
CPC ..... *F28F 1/00* (2013.01); *F24F 1/0059* (2013.01); *F24F 1/18* (2013.01); *F25B 1/00* (2013.01); *F28D 1/0477* (2013.01); *F28F 1/42* (2013.01); *F28F 21/084* (2013.01)

(58) Field of Classification Search
CPC ..... F24F 1/18; F24F 1/0059; F25B 1/00; F25B 39/00; F28D 1/0477; F28F 1/42; F28F 1/422; F28F 1/00; F28F 1/10; F28F 1/40
USPC ..... 165/184
See application file for complete search history.

(56) References Cited

U.S. PATENT DOCUMENTS 3,273,599 A * 9/1966 Heeren ..... F28F 1/40 138/38
5,862,857 A * 1/1999 Ishikawa ..... F25B 39/00 165/133

(Continued)

FOREIGN PATENT DOCUMENTS

CN 1955629 A 5/2007
CN 101842637 A 9/2010

(Continued)

OTHER PUBLICATIONS

Office Action issued on Sep. 6, 2015 in the corresponding CN application No. 201280062765.7 (with English translation).

(Continued)

*Primary Examiner* — Tho V Duong
(74) *Attorney, Agent, or Firm* — Posz Law Group, PLC

(57) ABSTRACT

An air-conditioning apparatus includes an outdoor unit equipped with an outdoor-side heat exchanger formed by inserting a plurality of heat transfer pipes made of a metal material, such as aluminum or an aluminum alloy, into a plurality of fins, and an indoor unit equipped with an indoor-side heat exchanger formed by inserting a plurality of heat transfer pipes made of a metal material, such as aluminum or an aluminum alloy, into a plurality of fins. The heat transfer pipes in the outdoor-side heat exchanger are each internally provided with a plurality of straight grooves substantially parallel to the pipe axial direction. The heat transfer pipes in the indoor-side heat exchanger are each internally provided with a plurality of spiral grooves having a predetermined lead angle.

6 Claims, 8 Drawing Sheets

(51) Int. Cl.

| | |
|---|---|
| ***F25B 1/00*** | (2006.01) |
| ***F28F 1/42*** | (2006.01) |
| ***F28F 21/08*** | (2006.01) |
| ***F24F 1/00*** | (2011.01) |
| ***F24F 1/18*** | (2011.01) |

(56) References Cited

U.S. PATENT DOCUMENTS

| | | | | |
|---|---|---|---|---|
| 8,091,615 | B2 * | 1/2012 | Houfuku | F28F 1/40 165/133 |
| 2007/0089868 | A1 | 4/2007 | Houfuku et al. | |
| 2010/0218533 | A1 * | 9/2010 | Lee | B21D 53/08 62/259.1 |
| 2011/0000254 | A1 * | 1/2011 | Lee | F25B 39/00 62/498 |
| 2012/0285190 | A1 * | 11/2012 | Lee | F25B 39/00 62/238.6 |
| 2013/0199766 | A1 | 8/2013 | Lee | |

FOREIGN PATENT DOCUMENTS

| | | | |
|---|---|---|---|
| EP | 2213953 | A1 | 8/2010 |
| EP | 2278252 | A1 | 1/2011 |
| JP | 63-172894 | A | 7/1988 |
| JP | 07-332805 | A | 12/1995 |
| JP | 2001-124480 | A | 5/2001 |
| JP | 2001-289585 | A | 10/2001 |
| JP | 2010-145023 | A | 7/2010 |
| WO | 2009/069679 | A1 | 6/2009 |
| WO | 2009/131072 | A1 | 10/2009 |
| WO | 2010/016516 | A1 | 2/2010 |

OTHER PUBLICATIONS

Extended European Search Report issued Oct. 28, 2015 in the corresponding EP application No. 12860552.4.

Japanese Office Action dated Jun. 16, 2015 in the corresponding JP Patent application No. 2013-550053. ( English translation attached).

Office Action mailed Dec. 2, 2014 issued in corresponding JP patent application No. 2013-550053 (and English translation).

International Search Report of the International Searching Authority mailed Sep. 11, 2012 for the corresponding international application no. PCT/JP2012/003854 (and English translation).

Office Action mailed Aug. 23, 2016 issued in corresponding JP patent application No. 2013-550053 (and English translation).

* cited by examiner (a)

(b)

(a)

(b)

AIR-CONDITIONING APPARATUS

CROSS REFERENCE TO RELATED APPLICATION

This application is a U.S. national stage application of International Application No. PCT/JP2012/003854 filed on Jun. 13, 2012, and is based on Japanese Patent Application No. 2011-276718 filed on Dec. 19, 2011, the disclosures of which are incorporated by reference.

TECHNICAL FIELD

The present invention relates to an air-conditioning apparatus that includes heat exchangers each having internally-grooved heat transfer pipes made of a metal material, such as aluminum or an aluminum alloy.

BACKGROUND ART

Conventionally, a heat-pump air-conditioning apparatus including a fin-tube heat exchanger including fins and heat transfer pipes (tubes) has been known. The fins of the fin-tube heat exchanger are arranged at regular intervals and allow a gas (air) to flow therebetween. The heat transfer pipes of the fin-tube heat exchanger are internally grooved, are perpendicularly inserted into each fin, and allow a refrigerant to flow therein.

An air-conditioning apparatus generally includes an evaporator, a compressor, a condenser, an expansion valve, and a four-way valve. The evaporator evaporates a refrigerant and cools air, water, and the like with evaporation heat of the refrigerant. The compressor compresses the refrigerant discharged from the evaporator to a high temperature, and supplies it to the condenser. The condenser heats air, water, and the like with heat of the refrigerant. The expansion valve expands the refrigerant discharged from the condenser to a low temperature, and supplies it to the evaporator. The four-way valve switches between a heating operation and a cooling operation by switching the direction in which the refrigerant flows in a refrigeration cycle. Heat transfer pipes are included in the condenser and the evaporator. A refrigerant containing refrigerating machine oil flows inside the heat transfer pipes.

In recent years, in consideration of rising copper costs, recyclability, and the like, a metal material, such as aluminum or an aluminum alloy, is used to form heat transfer pipes of condensers and evaporators. To attain a high-performance heat exchanger, a technique has been proposed in which a grooved pipe internally provided with straight grooves is used as a heat transfer pipe of the heat exchanger (see e.g., Patent Literature 1). Such straight-grooved pipes have a heat transfer performance better than that of bare pipes. Therefore, when such straight-grooved pipes are used in heat exchangers mounted in an outdoor unit and an indoor unit, the performance of the air-conditioning apparatus can be improved.

Again in recent years, spirally-grooved pipes internally provided with spiral grooves have been developed. With such spirally-grooved pipes, it is possible to achieve a heat exchanger effectiveness higher than that when straight-grooved pipes are used to further improve the performance of the air-conditioning apparatus.

CITATION LIST

Patent Literature

Patent Literature 1: Japanese Unexamined Patent Application Publication No. 2001-289585 (FIG. 1)

SUMMARY OF INVENTION

Technical Problem

However, in an air-conditioning apparatus where grooved pipes made of a metal material, such as aluminum or an aluminum alloy, are used as heat transfer pipes of heat exchangers, when the heat exchanger mounted in the indoor unit and the heat exchanger mounted in the outdoor unit use the same type of grooved pipes, the performance of the air-conditioning apparatus degrades contrary to expectations.

Also, because of the low strength of an aluminum material, heat transfer pipes need to have a large wall thickness at the groove bottoms. This increases the pressure loss in the heat transfer pipe.

The present invention has been made to solve the aforementioned problems, and provides an air-conditioning apparatus that includes heat exchangers each formed by inserting heat transfer pipes made of a metal material, such as aluminum or an aluminum alloy, into a plurality of fins, and provides improved efficiency.

Solution to Problem

An air-conditioning apparatus according to the present invention includes an outdoor unit equipped with an outdoor-side heat exchanger formed by inserting a plurality of heat transfer pipes made of a metal material, such as aluminum or an aluminum alloy, into a plurality of fins; and an indoor unit equipped with an indoor-side heat exchanger formed by inserting a plurality of heat transfer pipes made of a metal material, such as aluminum or an aluminum alloy, into a plurality of fins. The heat transfer pipes in the outdoor-side heat exchanger are each internally provided with a plurality of straight grooves substantially parallel to the pipe axial direction. The heat transfer pipes in the indoor-side heat exchanger are each internally provided with a plurality of spiral grooves having a predetermined lead angle.

Advantageous Effects of Invention

In the present invention, the heat transfer pipes in the outdoor-side heat exchanger are each internally provided with straight grooves, and the heat transfer pipes in the indoor-side heat exchanger are each internally provided with spiral grooves. Therefore, it is possible to improve the heat exchanger capability of the indoor-side heat exchanger without increasing the in-pipe pressure loss in the outdoor-side heat exchanger to, in turn, improve the efficiency of the air-conditioning apparatus.

DESCRIPTION OF EMBODIMENTS

Embodiment 1

Figure 1:
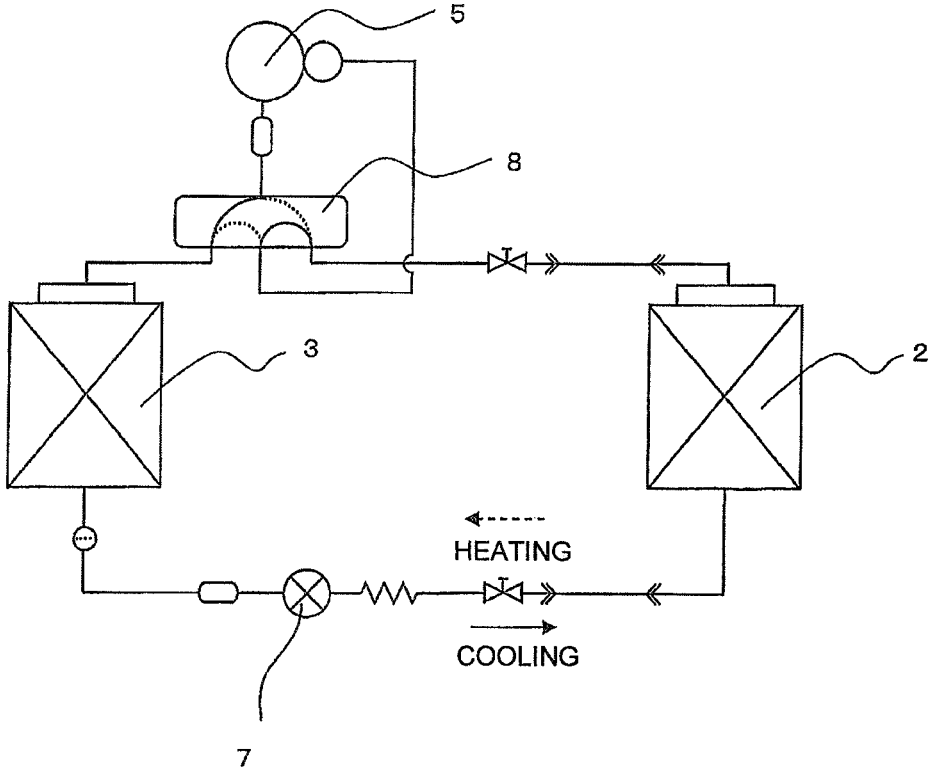
FIG. 1 illustrates an exemplary configuration of an air-conditioning apparatus according to Embodiment 1 of the present invention.

FIG. 1 illustrates an exemplary configuration of an air-conditioning apparatus according to Embodiment 1 of the present invention.

As illustrated in FIG. 1, the air-conditioning apparatus has a refrigeration cycle in which a compressor 5, a four-way valve 8, an outdoor-side heat exchanger 3 mounted in an outdoor unit, an expansion valve 7 serving as an expanding means, and an indoor-side heat exchanger 2 mounted in an indoor unit are sequentially connected by refrigerant pipes, and which circulates a refrigerant.

The four-way valve 8 switches between a heating operation and a cooling operation by switching the direction in which the refrigerant flows in the refrigeration cycle. The four-way valve 8 may be omitted if a cooling-only or heating-only air-conditioning apparatus is set. The outdoor-side heat exchanger 3 functions as a condenser during cooling operation to heat air and the like with heat of the refrigerant, and functions as an evaporator during heating operation to evaporate the refrigerant and thereby cool air and the like with the evaporation heat of the refrigerant. The indoor-side heat exchanger 2 functions as an evaporator for evaporating the refrigerant during cooling operation, and functions as a condenser for condensing the refrigerant during heating operation. The compressor 5 compresses the refrigerant discharged from the evaporator to a high temperature, and supplies it to the condenser. The expansion valve 7 expands the refrigerant discharged from the condenser to a low temperature, and supplies it to the evaporator. The refrigerant used is a single-component hydrocarbon refrigerant, a refrigerant mixture containing a hydrocarbon, R32, R410A, R407C, or carbon dioxide. Because of the low strength of an aluminum material, heat transfer pipes are formed with a large wall thickness at the groove bottoms. This increases the pressure loss in the heat transfer pipe. When a hydrocarbon refrigerant, a refrigerant mixture containing a hydrocarbon, R32, R410A, R407C, or carbon dioxide, which is small in in-pipe pressure loss, is used, it is possible to enhance in-pipe heat transfer performance in evaporation without increasing the pressure loss, and thus to provide a highly efficient heat exchanger.

In the following description, the indoor-side heat exchanger 2 and the outdoor-side heat exchanger 3 will be generically referred to as a heat exchanger 1 unless a distinction must be made between them.

Figure 2:
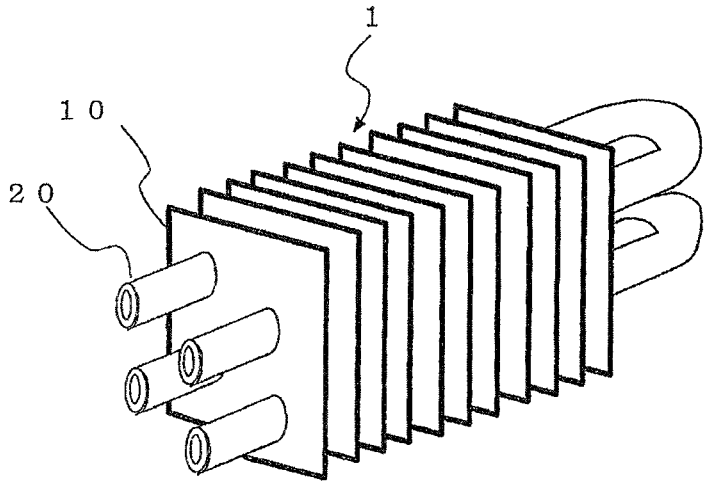
FIG. 2 illustrates a heat exchanger according to Embodiment 1 of the present invention.
Figure 2:
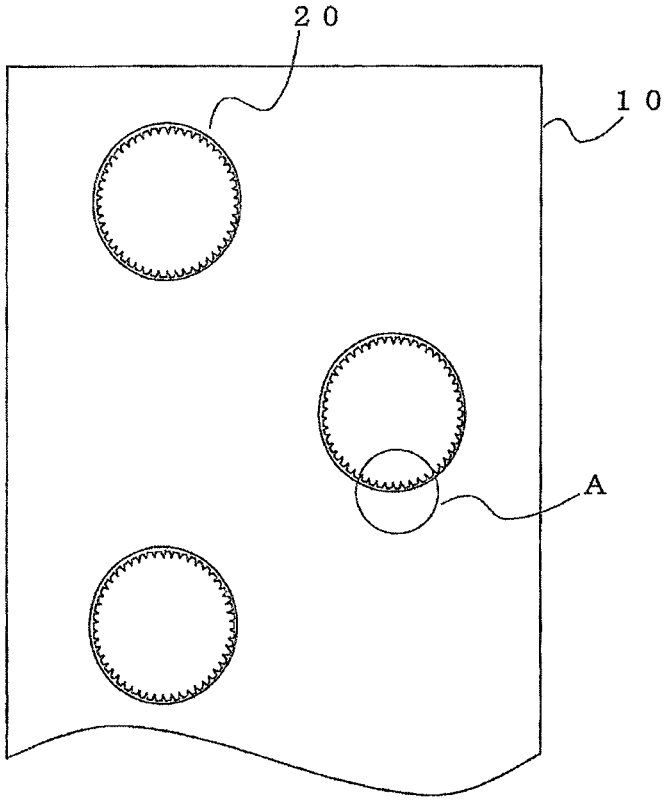

FIG. 2 illustrates a heat exchanger according to Embodiment 1 of the present invention.

Referring to FIG. 2, the heat exchanger 1 is a fin-tube heat exchanger widely used as an evaporator and a condenser of a refrigeration apparatus, an air-conditioning apparatus, and the like. FIG. 2(*a*) is a vertical-cutaway perspective view of the heat exchanger 1. FIG. 2(*b*) shows a partial cross-section of the heat exchanger 1 as viewed sideways.

The heat exchanger 1 includes a plurality of fins 10 and heat transfer pipes 20 for heat exchangers. The heat transfer pipes 20 pass through through-holes formed in each of the plurality of fins 10 arranged at predetermined intervals. The heat transfer pipes 20 constitute part of a refrigerant circuit in the refrigeration cycle, and a refrigerant flows through them. Heat of the refrigerant flowing inside the heat transfer pipes 20 and heat of air flowing outside the heat transfer pipes 20 are transferred through the fins 10. This increases the heat transfer area which defines a surface of contact with air, and allows efficient heat exchange between the refrigerant and the air.

Figure 3:
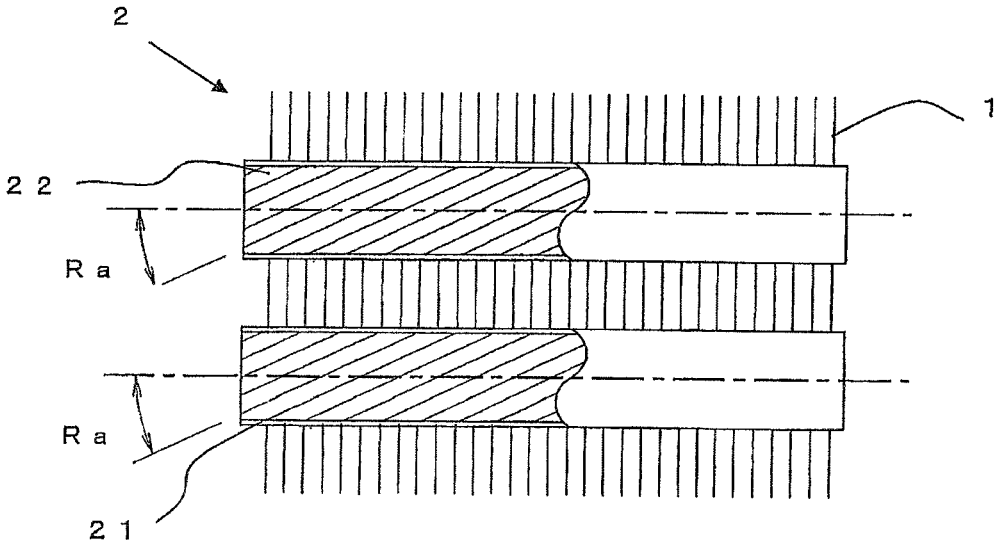
FIG. 3 shows partial enlarged views of vertical cross-sections of heat exchangers according to Embodiment 1 of the present invention, as viewed from the front side.
Figure 3:
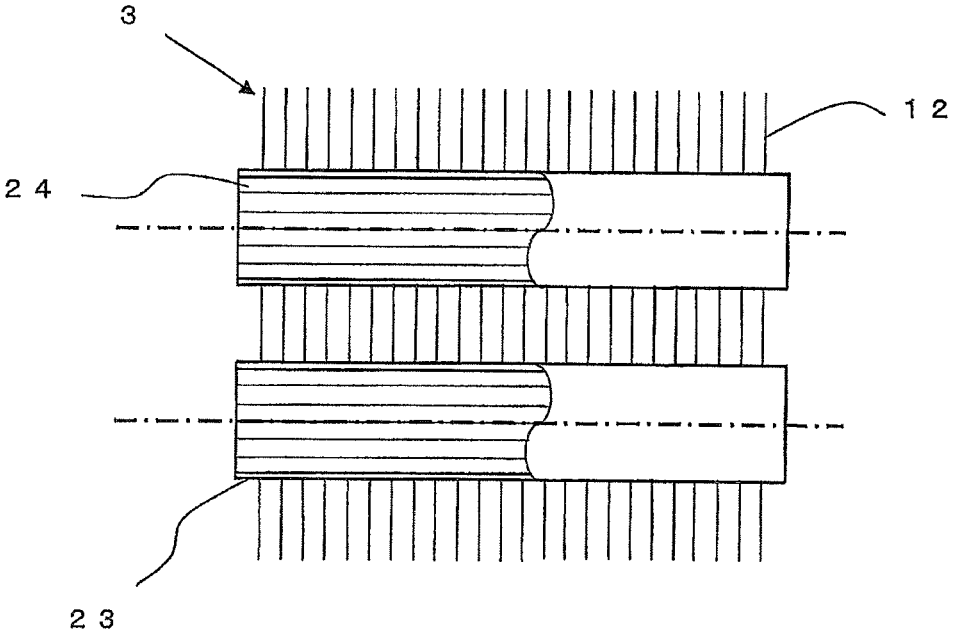

FIG. 3 shows partial enlarged views of vertical cross-sections of heat exchangers according to Embodiment 1 of the present invention, as viewed from the front side. FIG. 3(*a*) is a partial enlarged view of a vertical cross-section of the indoor-side heat exchanger 2 as viewed from the front side. FIG. 3(*b*) is a partial enlarged view of a vertical cross-section of the outdoor-side heat exchanger 3 as viewed from the front side. Both FIGS. 3(*a*) and 3(*b*) show cross-sections of adjacent heat transfer pipes and fins crossing these pipes.

Fins 11 of the indoor-side heat exchanger 2 are made of a metal material with high thermal conductivity, such as aluminum or an aluminum alloy, as illustrated in FIG. 3(*a*). Heat transfer pipes 21 passing through the fins 11 are made of a metal material with high thermal conductivity, such as aluminum or an aluminum alloy. The heat transfer pipes 21 of the indoor-side heat exchanger 2 are each internally provided with a plurality of spiral grooves 22 having a predetermined lead angle Ra.

Fins 12 of the outdoor-side heat exchanger 3 are made of a metal material with high thermal conductivity, such as aluminum or an aluminum alloy, as illustrated in FIG. 3(*b*). Heat transfer pipes 23 passing through the fins 12 are made of a metal material with high thermal conductivity, such as aluminum or an aluminum alloy. The heat transfer pipes 23 of the outdoor-side heat exchanger 3 are each internally provided with a plurality of straight grooves 24 almost parallel to the pipe axial direction.

A comparison of both the heating performance and the cooling performance is made between the use of the same type of heat transfer pipes and the use of the heat transfer pipes 21 and 23 of Embodiment 1 as heat transfer pipes of the indoor-side heat exchanger 2 and the outdoor-side heat exchanger 3.

Figure 4:
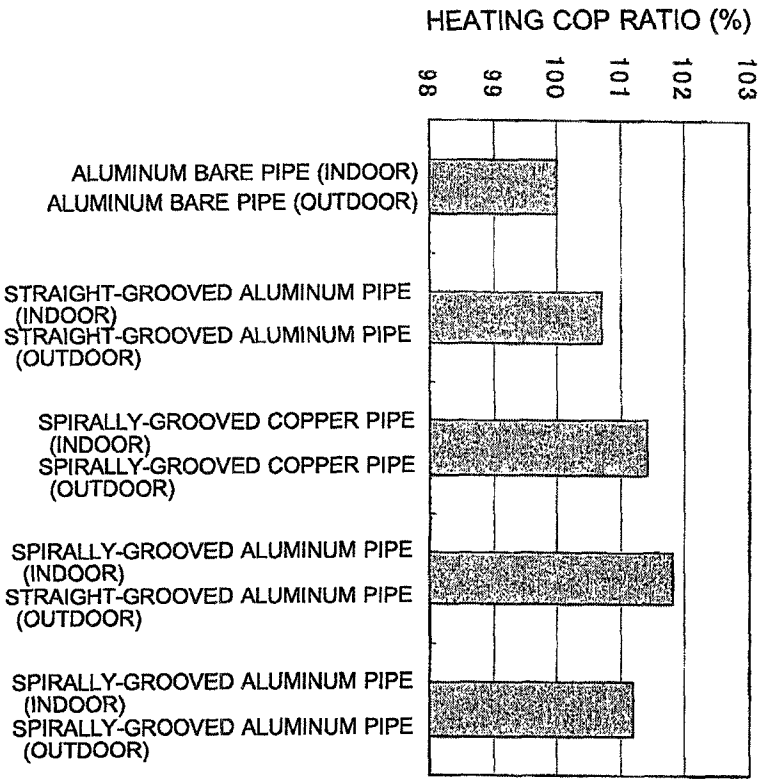
FIG. 4 is a graph showing the heating coefficient of performance (COP) ratio obtained when a combination of a plurality of types of heat transfer pipes is used for an indoor-side heat exchanger and an outdoor-side heat exchanger.

FIG. 4 is a graph showing the heating coefficient of performance (COP) ratio obtained when a combination of a plurality of types of heat transfer pipes is used for the indoor-side heat exchanger and the outdoor-side heat exchanger.

As shown in FIG. 4, when aluminum heat transfer pipes each internally provided with straight grooves (straight-grooved aluminum pipes) are used for both the indoor unit and the outdoor unit, the heat exchanger effectiveness of the heat exchangers is higher and the heating performance (heating coefficient of performance ratio), in turn, is higher than when aluminum bare pipes are used for both the indoor unit and the outdoor unit. When aluminum heat transfer pipes each internally provided with spiral grooves (spirally-grooved aluminum pipes) are used for both the indoor unit and the outdoor unit, the heat exchanger effectiveness of the heat exchangers is higher and the heating performance, in turn, is higher than when aluminum bare pipes or straight-grooved aluminum pipes are used for both the indoor unit and the outdoor unit.

However, the heating performance is lower when spirally-grooved aluminum pipes are used for both the indoor unit and the outdoor unit than when copper heat transfer pipes each internally provided with spiral grooves (spirally-grooved copper pipes) are used for both the indoor unit and the outdoor unit. This is because since the strength of aluminum is lower than that of copper material and aluminum heat transfer pipes therefore need to have a large wall thickness at the groove bottoms, the pressure loss in in-pipe evaporation in the outdoor-side heat exchanger 3 is relatively high.

On the other hand, the heating performance is higher when, as in Embodiment 1, aluminum heat transfer pipes with the spiral grooves 22 (spirally-grooved aluminum pipes) are used as the heat transfer pipes 21 in the indoor-side heat exchanger 2 of the indoor unit and aluminum heat transfer pipes with the straight grooves 24 (straight-grooved aluminum pipes) are used as the heat transfer pipes 23 in the outdoor-side heat exchanger 3 of the outdoor unit than when spirally-grooved copper pipes or spirally-grooved aluminum pipes are used for both the indoor unit and the outdoor unit.

This is because when straight-grooved pipes with a low in-pipe pressure loss are used as the heat transfer pipes 23 in the outdoor-side heat exchanger 3, a current that flows over the grooves of each heat transfer pipe 23 in the outdoor-side heat exchanger 3 is less likely to occur and the heat exchanger effectiveness can be improved without increasing the in-pipe pressure loss. Thus, with the configuration of Embodiment 1, it is possible to improve the heating efficiency to obtain a highly efficient air-conditioning apparatus.

Figure 5:
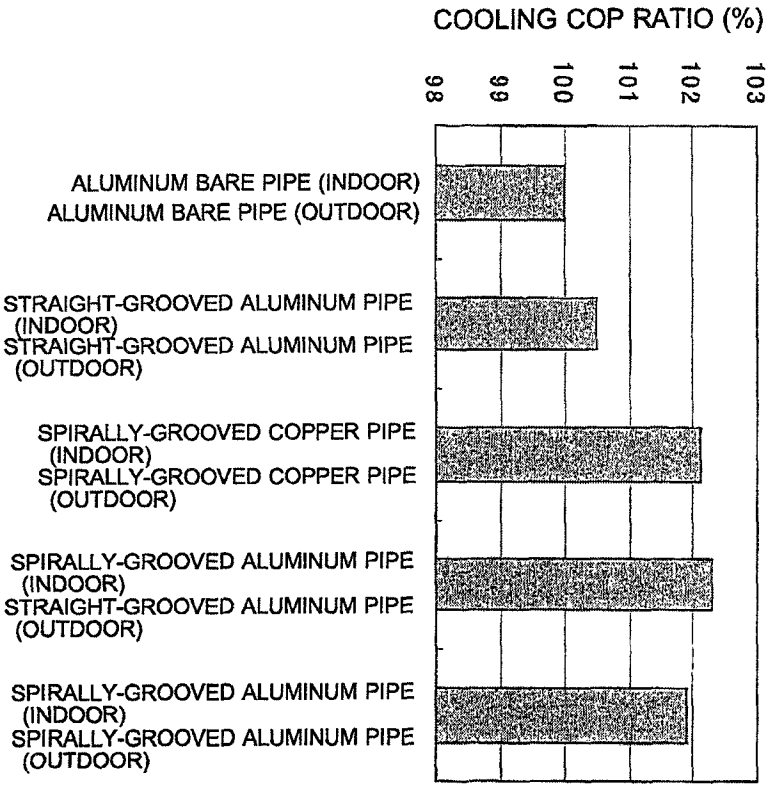
FIG. 5 is a graph showing the cooling coefficient of performance (COP) ratio obtained when a combination of a plurality of types of heat transfer pipes is used for the indoor-side heat exchanger and the outdoor-side heat exchanger.

FIG. 5 is a graph showing the cooling coefficient of performance (COP) ratio obtained when a combination of a plurality of types of heat transfer pipes is used for the indoor-side heat exchanger and the outdoor-side heat exchanger.

As shown in FIG. 5, when straight-grooved aluminum pipes are used for both the indoor unit and the outdoor unit, the heat exchanger effectiveness of the heat exchangers is higher and the cooling performance (cooling coefficient of performance ratio), in turn, is higher than when aluminum bare pipes are used for both the indoor unit and the outdoor unit.

However, the cooling performance is lower when straight-grooved aluminum pipes are used for both the indoor unit and the outdoor unit than when spirally-grooved aluminum pipes are used for both the indoor unit and the outdoor unit. This is because, in rated cooling operation in which the refrigerant flow rate is high, a vapor refrigerant flows fast at the center of the pipe, and a liquid film near the wall surface peels, so that the in-pipe heat transfer coefficient in the indoor-side heat exchanger 2 lowers, and the evaporation performance degrades.

The cooling performance is lower when spirally-grooved aluminum pipes are used for both the indoor unit and the outdoor unit than when spirally-grooved copper pipes are used for both the indoor unit and the outdoor unit. This is because since the strength of aluminum is lower than that of a copper material and aluminum heat transfer pipes need to have a large wall thickness at the groove bottoms, the in-pipe pressure loss in the outdoor-side heat exchanger 3 is relatively high. Also, since the outdoor-side heat exchanger 3 is larger in size than the indoor-side heat exchanger 2, the heat transfer pipes in the outdoor-side heat exchanger 3 are relatively long. Therefore, the in-pipe pressure loss is relatively high in the outdoor-side heat exchanger 3.

The cooling performance is higher when, as in Embodiment 1, aluminum heat transfer pipes with the spiral grooves 22 (spirally-grooved aluminum pipes) are used as the heat transfer pipes 21 in the indoor-side heat exchanger 2 of the indoor unit and aluminum heat transfer pipes with the straight grooves 24 (straight-grooved aluminum pipes) are used as the heat transfer pipes 23 in the outdoor-side heat exchanger 3 of the outdoor unit than when spirally-grooved copper pipes or spirally-grooved aluminum pipes are used for both the indoor unit and the outdoor unit.

This is because when spirally-grooved pipes having a high heat transfer coefficient are used as the heat transfer pipes 21 of the indoor-side heat exchanger 2, even if a vapor refrigerant flows fast at the center of the pipe in rated cooling operation in which the refrigerant flow rate is high, it is possible to suppress peeling of a liquid film near the wall surface, suppress a decrease in in-pipe heat transfer coefficient in the indoor-side heat exchanger 2, and suppress degradation in evaporation performance.

Also, when straight-grooved pipes with a low in-pipe pressure loss are used as the heat transfer pipes 23 in the outdoor-side heat exchanger 3, a current that flows over the grooves of each heat transfer pipe 23 in the outdoor-side heat exchanger 3 is less likely to occur and the heat exchanger effectiveness can be improved without an increase in in-pipe pressure loss. Thus, with the configuration of Embodiment 1, it is possible to improve the cooling efficiency to obtain a highly efficient air-conditioning apparatus.

This can provide a highly efficient air-conditioning apparatus in both cooling and heating operations.

In a refrigeration cycle in which the compressor, condenser, expansion device, and evaporator are sequentially connected by pipes and which uses a refrigerant as a working fluid, the heat exchangers of Embodiment 1 are used as evaporators or condensers and contribute to an improvement in coefficient of performance (COP). Also, the heat exchangers of Embodiment 1 improve the efficiency of heat exchange between the refrigerant and the air. Therefore, the annual performance factor (APF) is expected to improve.

To reduce the pressure loss in a heat exchanger, it is also possible to increase the number of passes or to increase the diameter of each heat transfer pipe. However, increasing the number of passes increases the manufacturing cost of the heat exchanger. Also, increasing the diameter of each heat transfer pipe leads to an increased amount of refrigerant filled or to degraded performance on the air side. Therefore, using different types of heat transfer pipes as the heat transfer pipes 21 of the indoor-side heat exchanger 2 and the heat transfer pipes 23 of the outdoor-side heat exchanger 3 is expected to produce better effects.

The lead angle Ra of the spiral grooves 22 will now be described.

In Embodiment 1, the lead angle Ra of the spiral grooves 22 of the heat transfer pipes 21 in the indoor-side heat exchanger 2 is set to be 5 degrees to 30 degrees larger than the lead angle of the straight grooves 24 of the heat transfer pipes 23 in the outdoor-side heat exchanger 3.

This is because if the lead angle Ra of the helical grooves 22 of the heat transfer pipes 21 in the indoor-side heat exchanger 2 is less than 5 degrees, the heat exchanger effectiveness significantly degrades. On the other hand, if the lead angle Ra of the helical grooves 22 of the heat transfer pipes 21 in the indoor-side heat exchanger 2 is more than 30 degrees, the in-pipe pressure loss significantly increases. When the lead angle Ra of the spiral grooves 22 is set in the aforementioned way, it is possible to improve the in-pipe heat transfer performance in the indoor-side heat exchanger 2 to obtain a highly efficient indoor-side heat exchanger 2.

The shapes of the spiral grooves 22 and the straight grooves 24 will now be described.

In the following description, the spiral grooves 22 and the straight grooves 24 will be generically referred to as grooves 26 unless a distinction must be made between them.

Figure 6:
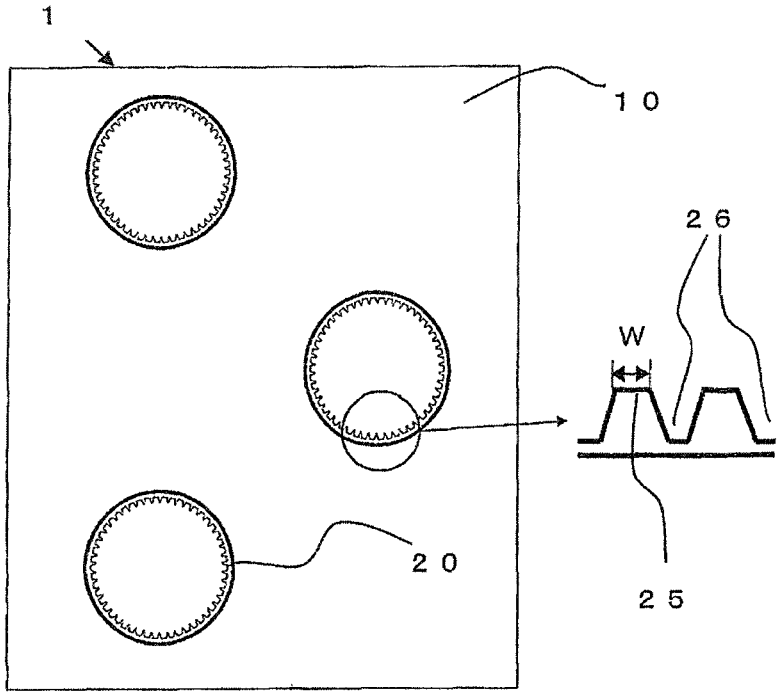
FIG. 6 is a partial enlarged view of a vertical cross-section of a heat exchanger according to Embodiment 1 of the present invention, as viewed sideways.

FIG. 6 is a partial enlarged view of a vertical cross-section of a heat exchanger according to Embodiment 1 of the present invention, as viewed sideways. The partial enlarged view in FIG. 6 corresponds to part A in FIG. 2(*b*).

In the heat exchanger 1 of Embodiment 1, the heat transfer pipes 20 and the fins 10 are joined together by expanding the heat transfer pipes 20 using a mechanical pipe expanding technique (to be described later).

As illustrated in FIG. 6, the crest of a thread 25 formed between grooves 26 of each heat transfer pipe 20 has a trapezoidal top shape after pipe expansion, and a top width W of the crest is set to fall within the range of 0.20 mm to 0.35 mm.

Since aluminum is less resistant to and more prone to deformation than copper, the crest of the thread 25 is crushed and tilted considerably. When the top width W of the crest after expansion of the heat transfer pipe 20 is set to be 0.20 mm or more, the amount of crush of the thread 25 between grooves 26 and the amount of tilt of the thread 25 between grooves 26 can be reduced. On the other hand, if the top width W exceeds 0.35 mm, the cross-sectional area of the groove portion decreases. As a result, a refrigerant liquid film flows over the grooves 26, and the threads 25 are covered with the refrigerant liquid film, which reaches even their crests. This lowers the heat transfer coefficient.

With the configuration described above, it is possible to raise the adhesion level between the heat transfer pipes 20 and the fins 10 of the heat exchanger 1 to obtain a highly efficient heat exchanger 1.

Although a heat exchanger that uses spirally-grooved aluminum pipes is mounted in the indoor unit in the description above, a heat exchanger that uses spirally-grooved aluminum pipes and a heat exchanger that uses straight-grooved aluminum pipes may be mounted in the indoor unit.

Figure 7:
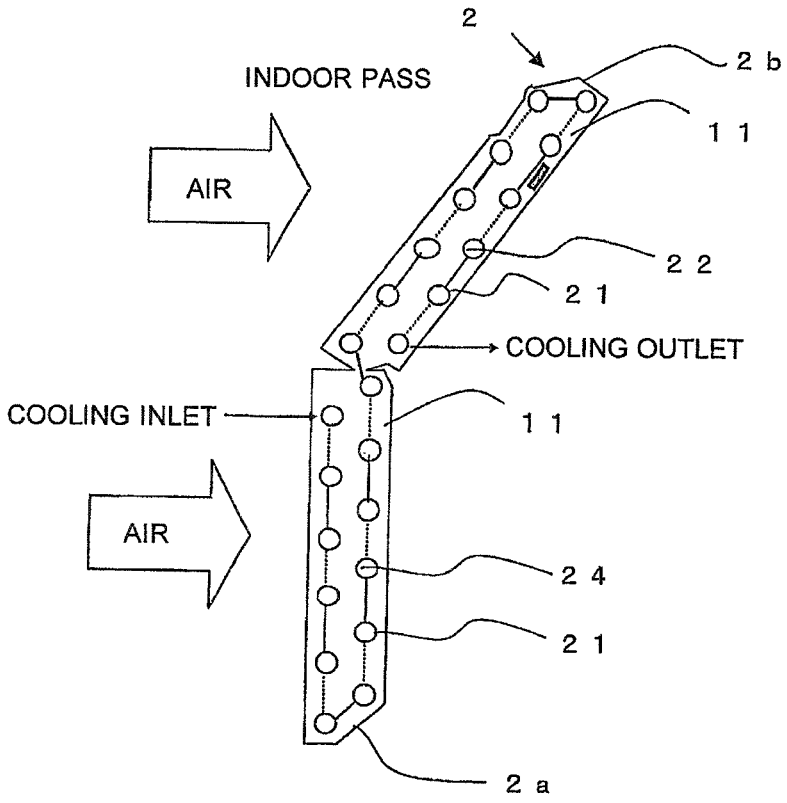
FIG. 7 illustrates another configuration of the indoor-side heat exchanger of the air-conditioning apparatus according to Embodiment 1 of the present invention.

FIG. 7 illustrates another configuration of the indoor-side heat exchanger of the air-conditioning apparatus according to Embodiment 1 of the present invention.

Referring to FIG. 7, the indoor-side heat exchanger 2 includes a first indoor-side heat exchanger 2*a* and a second indoor-side heat exchanger 2*b* which are connected by the heat transfer pipes 21. The fins 11 and the heat transfer pipes 21 of the first indoor-side heat exchanger 2*a* and the second indoor-side heat exchanger 2*b* are made of a metal material with high thermal conductivity, such as aluminum or an aluminum alloy.

In the first indoor-side heat exchanger 2*a*, each heat transfer pipe 21 is internally provided with straight grooves 24 almost parallel to the pipe axial direction. In the second indoor-side heat exchanger 2*b*, each heat transfer pipe 21 is internally provided with spiral grooves 22 having a predetermined lead angle Ra. The length of the heat transfer pipes 21 passing through the first indoor-side heat exchanger 2*a* is set to be, for example, almost equal to that of the heat transfer pipes 21 passing through the second indoor-side heat exchanger 2*b*. Refrigerant flow paths are connected such that when the indoor-side heat exchanger 2 is used as an evaporator, the refrigerant flows out of the first indoor-side heat exchanger 2*a* and then flows into the second indoor-side heat exchanger 2*b*.

That is, for the entire length of the heat transfer pipes 21 passing through the first indoor-side heat exchanger 2*a* and the second indoor-side heat exchanger 2*b*, an almost half length defined as a distance from a cooling inlet are provided with straight grooves and another almost half length defined as a distance from a cooling outlet are provided with spiral grooves.

Thus, with the straight grooves 24 in the first indoor-side heat exchanger 2*a*, a vapor refrigerant flows fast at the center of the pipe without increasing the in-pipe pressure loss. Also, with the spiral grooves 22 in the second indoor-side heat exchanger 2*b*, it is possible to suppress peeling of a liquid film near the wall surface, and prevent degradation in evaporation performance. Therefore, the in-pipe heat transfer performance in the indoor-side heat exchanger 2 can further be improved to obtain a highly efficient heat exchanger.

Embodiment 2

Figure 8:
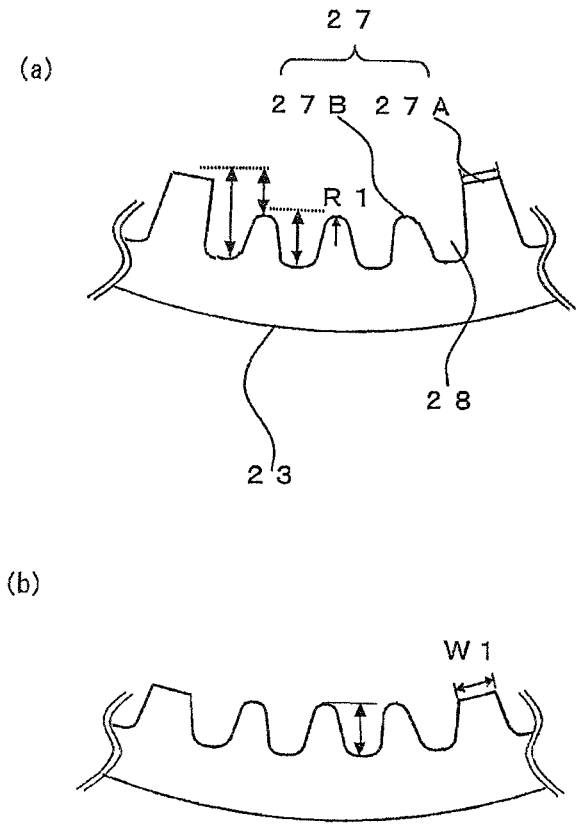
FIG. 8 illustrates the internal shapes of a heat transfer pipe in an outdoor-side heat exchanger according to Embodiment 2.

FIG. 8 illustrates the internal shapes of a heat transfer pipe of an outdoor-side heat exchanger according to Embodiment 2. FIG. 8(*a*) illustrates a state before pipe expansion, and FIG. 8(*b*) illustrates a state after pipe expansion. The partial enlarged view of FIG. 8(*b*) corresponds to part A in FIG. 2(*b*).

Each heat transfer pipe 23 in the outdoor-side heat exchanger 3 according to Embodiment 2 is internally provided with groove portions 28 and thread portions 27 produced by groove formation. The thread portions 27 include two types of threads: high threads 27A and low threads 27B. The high thread 27A has a trapezoidal shape with a flat crest before pipe expansion. The high thread 27A has a trapezoidal shape with a flat crest even after pipe expansion. The low thread 27B has a crest with a curved top shape (R1). The height of the low thread 27B is lower than that of the high thread 27A after pipe expansion.

The configuration of the indoor-side heat exchanger 2 is the same as that in Embodiment 1.

Pipe expansion which uses the mechanical pipe expanding technique will now be described.

Figure 9:
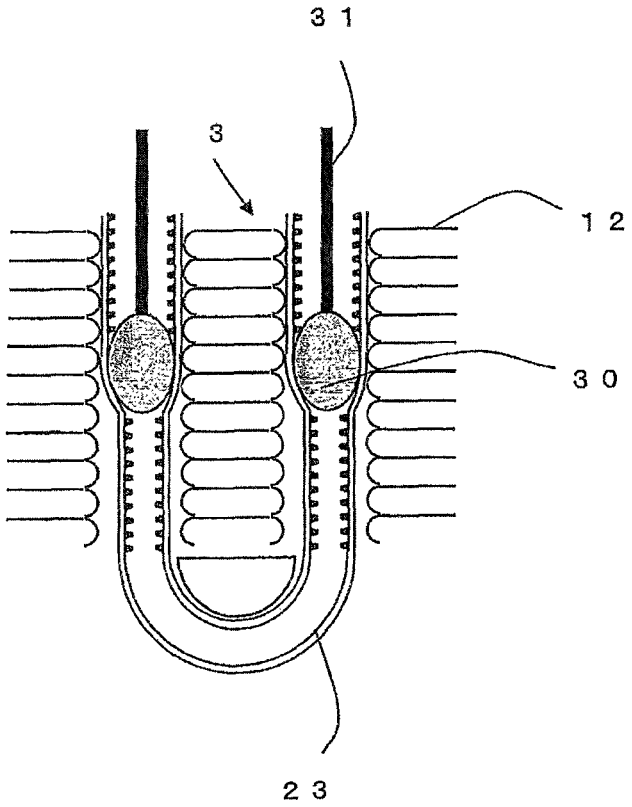
FIG. 9 illustrates how pipe expansion is performed using a mechanical pipe expanding technique.

FIG. 9 illustrates how pipe expansion is performed using the mechanical pipe expanding technique. First, the central part of the heat exchanger 1 in the longitudinal direction is bent into a hairpin shape at a predetermined bending pitch so as to produce a plurality of hairpin pipes which are to serve as the heat transfer pipes 23. After the hairpin pipes pass through through-holes in the fins 12, the hairpin pipes are expanded using the mechanical pipe expanding technique to bring the heat transfer pipes 23 into tight contact with the fins 12 and join them together. In the mechanical pipe expanding technique, the heat transfer pipes 23 are brought into tight contact with the fins 12 by inserting rods 31 each having a pipe expanding ball 30 at its end, into the heat transfer pipes 23 and increasing the outside diameter of the heat transfer pipes 23. The pipe expanding ball 30 has a diameter slightly larger than the inside diameter of the heat transfer pipes 23.

When pipe expansion is performed using the mechanical pipe expanding technique, the high threads 27A are crushed at their crest portions into flat, lower ones upon contact with the pipe expanding balls 30. On the other hand, the low threads 27B are free from deformation because their crest portions are lower than the level to which they are expected to lower upon crushing. Unlike the related art where pressure is applied to all thread portions in the pipe by insertion of the pipe expanding balls 30, the pipe is expanded by applying pressure to the high threads 27A. Therefore, the outer surface of the heat transfer pipe is processed into a polygonal shape, and springback of the heat transfer pipe can be suppressed. Thus, it is possible to improve the adhesion level between the heat transfer pipes 23 and the fins 12 to enhance the heat exchange efficiency.

Figure 10:
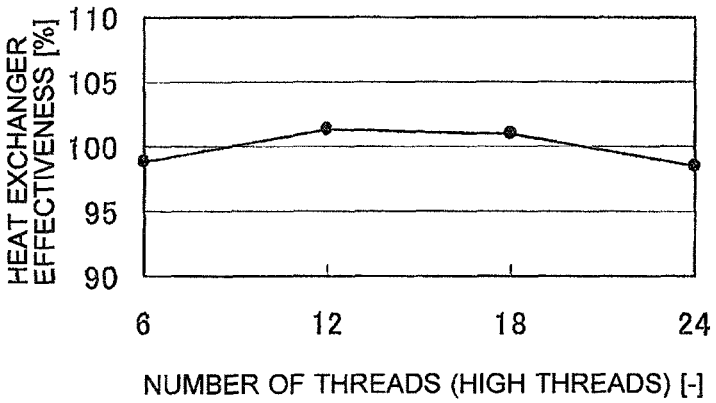
FIG. 10 shows the relationship between the number of high threads and the heat exchanger effectiveness.

FIG. 10 shows the relationship between the number of high threads and the heat exchanger effectiveness.

The number of high threads 27A formed on the inner wall surface of each heat transfer pipe 23 of Embodiment 2 falls within the range of 12 to 18. The number of low threads 27B formed between two adjacent high threads 27A falls within the range of 3 to 6.

As described above, the number of high threads 27A in each heat transfer pipe 23 of the outdoor-side heat exchanger 3 is set to be in the range of 12 to 18. This is because in pipe expansion, the pipe expanding balls 30 come into contact with the high threads 27A, so that the high threads 27A are crushed at their crest portions into flat, lower ones. In this case, if the number of high threads 27A in the heat transfer pipe 23 is smaller than 12, the low threads 27B are also crushed at their crest portions into flat ones, thus degrading the in-pipe heat transfer performance, as shown in FIG. 10. On the other hand, if the number of high threads 27A in the heat transfer pipe 23 is larger than 18, the number of low threads 27B decreases, thus degrading the in-pipe heat transfer performance.

As described above, in Embodiment 2, the thread portions 27 formed between grooves of the straight grooves 24 in each heat transfer pipe 23 of the outdoor-side heat exchanger 3 include 12 to 18 high threads 27A and 3 to 6 low threads 27B, each of which is formed between two adjacent high threads 27A, and the low threads 27B are lower in height than the high threads 27A after pipe expansion. Therefore, it is possible to improve the heat exchanger effectiveness without increasing the in-pipe pressure loss to obtain a highly efficient air-conditioning apparatus.

INDUSTRIAL APPLICABILITY

The present invention is applicable not only to air-conditioning apparatuses, but also to other refrigeration cycle apparatuses, such as refrigeration apparatuses and heat pump apparatuses, that include a heat exchanger forming a refrigerant circuit and serving as an evaporator and a condenser.

REFERENCE SIGNS LIST

1: heat exchanger, 2: indoor-side heat exchanger, 3: outdoor-side heat exchanger, 5: compressor, 7: expansion valve, 8: four-way valve, 10: fin, 11: fin, 12: fin, 20: heat transfer pipe, 21: heat transfer pipe, 22: spiral groove, 23: heat transfer pipe, 24: straight groove, 25: thread, 26: groove, 27: thread portion, 27A: high thread, 27B: low thread, 28: groove portion, 30: pipe expanding ball, 31: rod

The invention claimed is:

1. An air-conditioning apparatus comprising:

an outdoor unit equipped with an outdoor-side heat exchanger formed by inserting a plurality of heat transfer pipes made of a metal material including at least one of aluminum and an aluminum alloy into a plurality of fins; and an indoor unit equipped with an indoor-side heat exchanger formed by inserting a plurality of heat transfer pipes made of a metal material including at least one of aluminum and an aluminum alloy into a plurality of fins, wherein the heat transfer pipes in the outdoor-side heat exchanger are each internally provided with a plurality of straight grooves parallel to a pipe axial direction, and the heat transfer pipes in the indoor-side heat exchanger are each internally provided with a plurality of spiral grooves having a lead angle.

2. The air-conditioning apparatus of claim 1, wherein the lead angle of the spiral grooves of the heat transfer pipes in the indoor-side heat exchanger is 5 degrees to 30 degrees.

3. The air-conditioning apparatus of claim 1, wherein in the indoor-side heat exchanger and the outdoor-side heat exchanger, the heat transfer pipes and the fins are joined together by expanding the heat transfer pipes using a mechanical pipe expanding technique, and in the spiral grooves and the straight grooves, a crest of each thread formed between adjacent grooves has a trapezoidal top shape and a top width of 0.20 mm to 0.35 mm after the pipe expansion.

4. The air-conditioning apparatus of claim 1, wherein in the outdoor-side heat exchanger, the heat transfer pipes and the fins are joined together by expanding the heat transfer pipes using a mechanical pipe expanding technique, and in each heat transfer pipe of the outdoor-side heat exchanger, threads formed between grooves of the straight grooves include 12 to 18 high threads and 3 to 6 low threads, each of which is formed between two adjacent high threads, and the low threads are lower in height than the high threads after the pipe expansion.

5. The air-conditioning apparatus of claim 1, wherein the air-conditioning apparatus has a refrigeration cycle in which a compressor, the outdoor-side heat exchanger, an expansion device, and the indoor-side heat exchanger are connected by refrigerant pipes and which circulates a refrigerant, the indoor-side heat exchanger includes a first indoor-side heat exchanger including heat transfer pipes each internally provided with a plurality of straight grooves parallel to the pipe axial direction, and a second indoor-side heat exchanger including heat transfer pipes each internally provided with a plurality of spiral grooves having a lead angle, and when the indoor-side heat exchanger is used as an evaporator, the refrigerant flows out of the first indoor-side heat exchanger and then flows into the second indoor-side heat exchanger.

6. The air-conditioning apparatus of claim 1, wherein one of a single-component hydrocarbon refrigerant, a refrigerant mixture containing a hydrocarbon, R32, R410A, R407C, and carbon dioxide is used as a refrigerant.

* * * * *